US009425033B2

(12) United States Patent
Park

(10) Patent No.: US 9,425,033 B2
(45) Date of Patent: Aug. 23, 2016

(54) ION INJECTION DEVICE FOR A TIME-OF-FLIGHT MASS SPECTROMETER

(71) Applicant: Bruker Daltonics, Inc., Billerica, MA (US)

(72) Inventor: Melvin Andrew Park, Billerica, MA (US)

( * ) Notice: Subject to any disclaimer, the term of this patent is extended or adjusted under 35 U.S.C. 154(b) by 0 days.

(21) Appl. No.: 14/308,772

(22) Filed: Jun. 19, 2014

(65) Prior Publication Data

US 2015/0371840 A1 Dec. 24, 2015

(51) Int. Cl.
*H01J 49/40* (2006.01)
*H01J 49/06* (2006.01)

(52) U.S. Cl.
CPC ..... *H01J 49/40* (2013.01); *H01J 49/063* (2013.01); *H01J 49/403* (2013.01)

(58) Field of Classification Search
CPC ... H01J 49/401; H01J 49/423; H01J 49/4235
See application file for complete search history.

(56) References Cited

U.S. PATENT DOCUMENTS 5,763,878 A * 6/1998 Franzen ..... 250/292
5,783,824 A * 7/1998 Baba ..... H01J 49/423 250/281
6,465,792 B1 10/2002 Baptist
6,521,898 B2 * 2/2003 Chutjian ..... H01J 49/14 250/288
6,545,268 B1 * 4/2003 Verentchikov ..... H01J 49/004 250/281
7,872,228 B1 * 1/2011 Kim et al. ..... 250/292
7,935,924 B2 5/2011 Cheung et al.
7,939,810 B2 * 5/2011 Kawana ..... H01J 49/147 250/281
8,022,363 B2 * 9/2011 Iwamoto ..... H01J 49/164 250/281
8,507,848 B1 * 8/2013 Ding ..... H01J 49/066 250/281
2003/0066958 A1 * 4/2003 Okumura et al. ..... 250/286
2003/0168590 A1 * 9/2003 Weiss et al. ..... 250/286
2004/0135080 A1 * 7/2004 Ouyang et al. ..... 250/292
2005/0040327 A1 * 2/2005 Lee ..... A41C 5/005 250/288
2008/0210859 A1 * 9/2008 Tolley ..... H01J 49/424 250/282
2008/0283742 A1 * 11/2008 Takeuchi ..... H01J 49/067 250/288
2008/0290269 A1 * 11/2008 Saito et al. ..... 250/287
2009/0008543 A1 * 1/2009 Reinhold ..... H01J 49/427 250/282
2009/0206250 A1 * 8/2009 Wollnik ..... H01J 49/062 250/290

(Continued)

OTHER PUBLICATIONS

Schowalter, Stephen J. et al., An integrated ion trap and time-of-flight mass spectrometer for chemical and photo-reaction dynamics studies, Review of Scientific Instruments, Apr. 5, 2012, pp. 043103-1-043103-6, vol. 83, American Institute of Physics.

*Primary Examiner* — Nicole Ippolito
*Assistant Examiner* — Sean Luck
(74) *Attorney, Agent, or Firm* — Benoit & Cote, Inc.

(57) ABSTRACT

The invention provides methods and devices to pulse ions from an RF ion storage into the flight tube of a time-of-flight mass spectrometer. The pusher cell comprises essentially two parallel plates, both plates completely slotted into two electrically insulated halves. The four half plates can be supplied with RF voltages to form a two-dimensional quadrupole field in the center between the slits, or with DC voltages to form a homogeneous acceleration field to eject ions. The RF quadrupole field is not ideal, but sufficiently good to store ions, to damp the ions by an additional collision gas, and to form a fine thread of ions in the axis of the quadrupole field. The DC acceleration field is extremely homogeneous; slight distortions near the slits can be corrected by external electrodes. The ideal acceleration field results in a high mass resolution and the device does not show any mass discrimination.

19 Claims, 3 Drawing Sheets

(56) References Cited

U.S. PATENT DOCUMENTS

2009/0294655 A1* 12/2009 Ding ..... H01J 49/065 250/283
2010/0072362 A1* 3/2010 Giles et al. ..... 250/287
2011/0309244 A1* 12/2011 Whitehouse et al. ..... 250/287
2013/0009051 A1* 1/2013 Park ..... 250/282
2013/0099111 A1* 4/2013 Giles et al. ..... 250/282
2013/0105681 A1* 5/2013 Kovtoun ..... 250/282
2014/0048702 A1 2/2014 Green et al.

* cited by examiner

ION INJECTION DEVICE FOR A TIME-OF-FLIGHT MASS SPECTROMETER

BACKGROUND OF THE INVENTION

1. Field of the Invention

The invention relates to simple methods and devices to pulse ions into the flight tube of a time-of-flight mass spectrometer.

2. Description of the Related Art

Time-of-flight mass spectrometers with orthogonal injection of ions (abbreviated "OTOF") usually are built with pushers which pulse a part of a fine beam of ions orthogonally to its original flight direction into the flight tube of the mass spectrometer. To generate the fine beam of ions, the ions usually are stored in a linear radio frequency (RF) ion trap, having their kinetic energy damped, and accelerated by a lens-type accelerator with a low voltage in the range of three to ten volts. This type of operation has a severe disadvantage: when the distance between accelerator and pusher has been crossed by heavy ions in the range of tens of kilodaltons, and the pusher has been filled with these heavy ions, light ions in the range of a few hundred Daltons have flown about ten times the distance, and their concentration within the pusher appears to be diluted by a factor of ten. This operation shows a strong mass discrimination.

To avoid mass discrimination, ions can be pushed out of a storage device directly into the flight tube of the mass spectrometer. It is known for about two decades that ions can be pushed out of a linear RF rod system in such a manner that the ions leave the rod system normal to the axis of the rods through one of the gaps between the rods into the flight tube of the mass spectrometer (see, e.g., U.S. Pat. No. 5,763,878, J. Franzen). This method did not become accepted in mass spectrometric practice, because the resulting dipolar ejection was not very exact, and resulted in low mass resolution.

Experience has shown that the ejection by the dipolar field is critical. When the dipolar ejection field is not a truly homogeneous field without any superposition of higher order fields, the mass resolution is degraded. In Patent Application Publication US 2013/0009051 A1 (M. A. Park) pushing devices for time-of-flight mass spectrometers are presented which allow for switching over between almost ideal quadrupole fields (for storing the ions) and almost ideal dipole fields (to push out the ions). This publication shall be incorporated herein by reference in its entirety.

The device of US 2013/0009051 A1, however, consists of a high number of electrodes around the storage volume, hard to build and hard to supply precisely with the high number of voltages required.

SUMMARY OF THE INVENTION

The invention is based on the recognition that for an ion pusher used in time-of-flight mass spectrometers, an extremely homogeneous pushing field is essential, whereas the quality of the quadrupolar storage field is of lesser importance.

The invention provides methods and devices to pulse ions into the flight tube of time-of-flight mass spectrometers, whereby the devices are greatly simplified with respect to the devices such as presented in US 2013/0009051 A1. The inventive devices comprise four electrodes only, essentially arranged as two parallel plates, both plates completely slotted into two electrically insulated halves. The four half plates can be supplied with RF voltages to form a two-dimensional quadrupole field along the center between the slits, or with direct current (DC) voltages to form an ideal dipole field to eject the ions. The dipole field only shows some distortions near the slits and can be made still better by correction electrodes outside the space between the plates. In contrast, the requirements on the quadrupole field are much lower, it may be superimposed by multipole fields of higher order with considerable strength. But the quadrupole field is sufficiently good to store ions, to damp the ions by an additional collision gas, and to generate a cloud of ions in the form of a fine thread in the axis of the quadrupole field. The quadrupole storage cell can be closed at one or both sides by additional electrodes to generate a closed storage volume for the ions.

After the RF has been switched off, a short delay time without any field allows the ion cloud to expand, so that switching on the accelerating dipole field results in the well-known time focusing of ions of the same mass according to Wiley-McLaren (W. C. Wiley and I. H. McLaren: "Time-of-Flight Mass Spectrometer with Improved Resolution", Rev. Scient. Instr. 26, 1150 (1955)).

DETAILED DESCRIPTION

As already mentioned above, the invention is based on the recognition that for an ion pusher used in a time-of-flight mass spectrometer, an extremely homogeneous DC pushing field is essential, whereas the quality of the multipolar RF storage field is of lesser importance.

The invention provides methods and devices to pulse ions into the flight tube of a time-of-flight mass spectrometer, whereby the devices are greatly simplified with respect to the complex devices presented, for instance, in US 2013/0009051 A1. As shown in FIGS. 2 to 7, the essential part of a device according to principles of the invention may comprise four electrodes only, arranged as two parallel plates, a puller plate and a pusher plate, both plates completely slotted each into two electrically insulated halves. The puller plate comprises the halves (10) and (11), the pusher plate holds the electrodes (12) and (13). The distance between puller plate and Pusher plate may be chosen between two and four millimeters, the slit width may amount to values between 0.5 and 1.0 millimeter.

Figure 2:
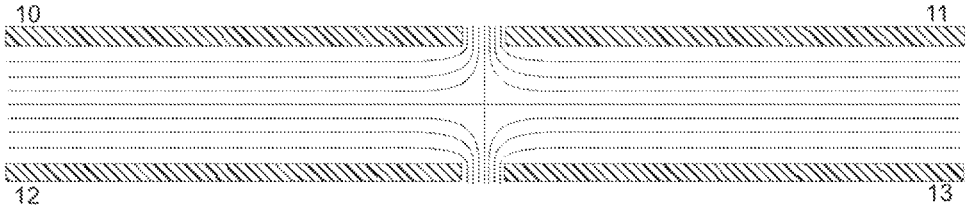
FIG. 2 shows the two puller half-plates (10) and (11), and the two pusher half-plates (12) and (13), with instantaneous equipotential lines of the RF voltage applied. One phase of the RF voltage is connected to half-plates (10) and (13), the other phase to half-plates (11) and (12). In the center, a quadrupole field is formed.
Figure 3:
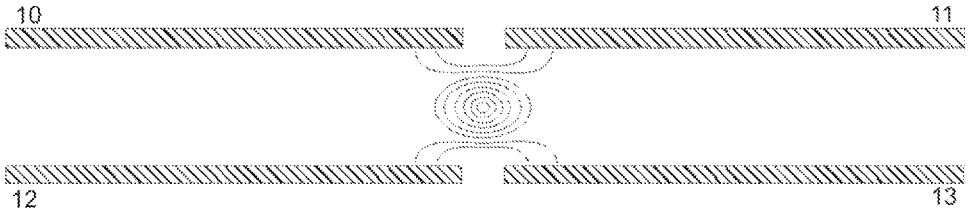
FIG. 3 presents the equigradient lines indicating the storage volume of the quadrupole field. When their kinetic energy is damped and thermalized by a collision gas, the ions will be stored as a fine string in the center. The ions are introduced normal to the plane of the picture, and held inside the storage volume by electrodes at the front and the end of the device (not visible).

The four half plates can be supplied cross-wise with the two phases of an RF voltage to form a two-dimensional (linear) quadrupole field in the center line parallel to the slits to form the storage field. For a distance of 2.3 millimeter between puller and pusher, and a slit width of 0.7 millimeter, a favorable RF voltage amounts to +/−300 volts. The storage field is not an ideally pure quadrupole field: the quadrupole field is superimposed by multipole fields of higher order with considerable strength. But the quadrupole field is sufficiently good to store ions, to damp the ions by an additional collision gas, and to generate a cloud of ions in the form of a fine thread in the axis of the quadrupole field. FIG. 2 presents a cross section through some equipotential surfaces. FIG. 3 shows equigradient surfaces of the pseudopotential formed by the RF voltage. These equigradient surfaces represent the strength of the pseudo-force field acting on the ions: the ions are driven back to the central axis. A linearly extended storage cell is formed. Ions of low kinetic energy can be brought into this storage cell along its axis, in the usual manner for linear ion traps. By a collision gas within this force field, ions can be damped within a few microseconds to form a cloud in the shape of a thin thread. Within a cell of a few centimeters in length, several ten thousand ions can be stored easily. In fact, well-damped ions gather in a single row, with distances in the order of one micrometer from ion to ion which is a relatively wide distance. Each ion swings around its average position by its thermal energy. So the actual diameter of the thread-like ion cloud is only determined by the temperature of the collision gas, and the repulsive forces of the pseudopotential.

Figure 4:
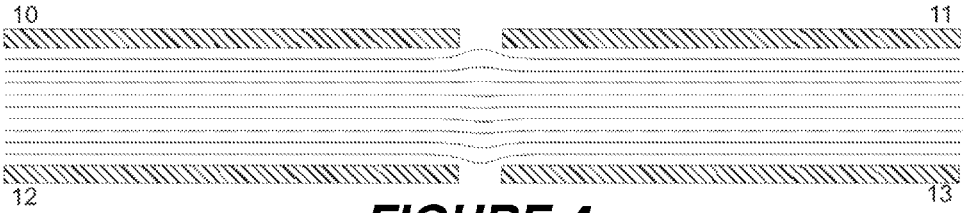
FIG. 4 depicts the dipolar field which appears if a DC voltage is supplied across the puller plate (10, 11) and the pusher plate (12, 13). The homogeneous dipolar field is somewhat distorted near the slits between the half-plates.

FIG. 4 presents the dipolar acceleration field between the four electrodes (10) to (13). The acceleration field is generated by a DC voltage between the puller half-plates (10) and (11) on one hand, and the pusher half-plates (12) and (13) on the other. Without further measures, the acceleration field is somewhat distorted near both slits. For the above mentioned distance of 2.3 millimeter between puller and pusher, and a slit width of 0.7 millimeter, the DC voltage may amount to +/−300 volts, with ground potential in the center plane of the device.

Figure 1:
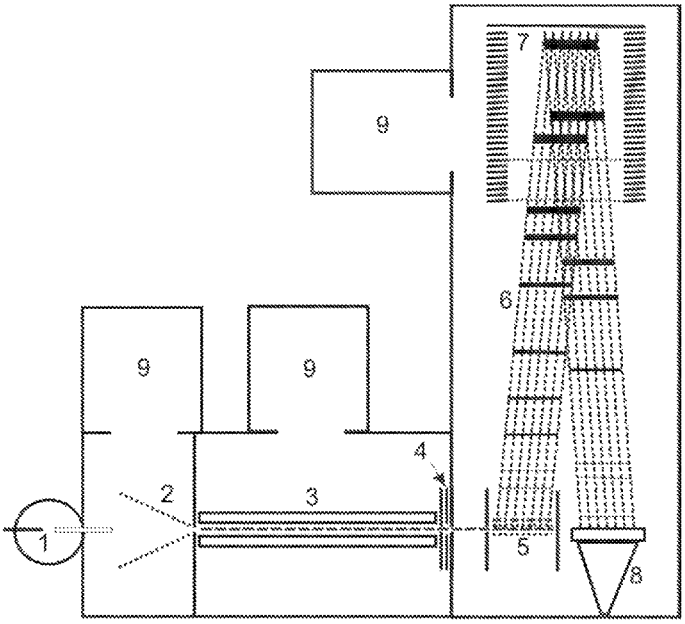
FIGURE 1 (PRIOR ART)
FIG. 1 shows a greatly simplified schematic representation of a time-of-flight mass spectrometer in accordance with prior art. Ions are generated at atmospheric pressure in an ion source (1) by a spray capillary, introduced into the vacuum system through an inlet capillary and collected by an ion funnel (2) guiding the ions into an RF quadrupole rod system (3) operating as an ion guide. The lens system (4) forms a fine beam. The pusher (5) accelerates ions from a segment of this fine beam orthogonally to its primary flight direction into the flight tube of the mass spectrometer, forming the beam (6) consisting of small linear ion clouds with ions of one mass each. This ion beam (6) is reflected with velocity focusing in the reflector (7) and measured with the detector (8). The mass spectrometer is evacuated by pumps (9).
Figure 5:
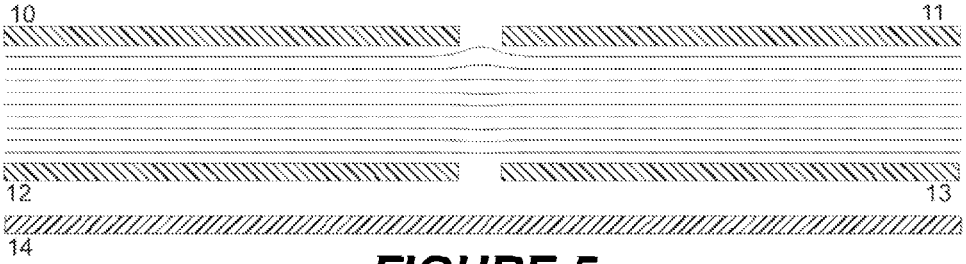
FIG. 5 shows how the distortion of the dipolar field can be corrected by a correction plate (14) and a strong correction voltage between this correction plate (14) and the pusher half-plates (12, 13).
Figure 6:
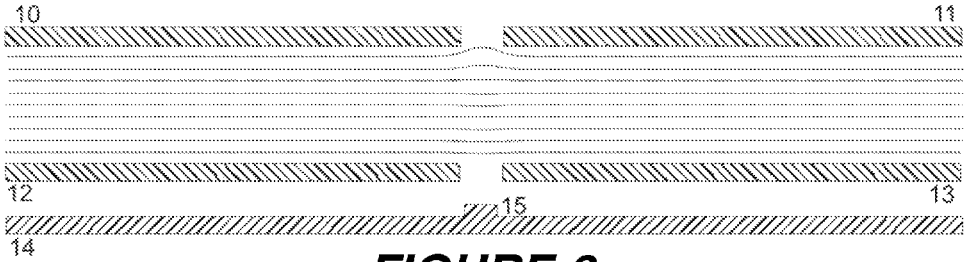
FIG. 6 presents a correction plate (14) with a protrusion (15) running along the slit between the half-plates (12) and (13). By the protrusion (15), the correction voltage can be greatly reduced to achieve the field correction.
Figure 7:
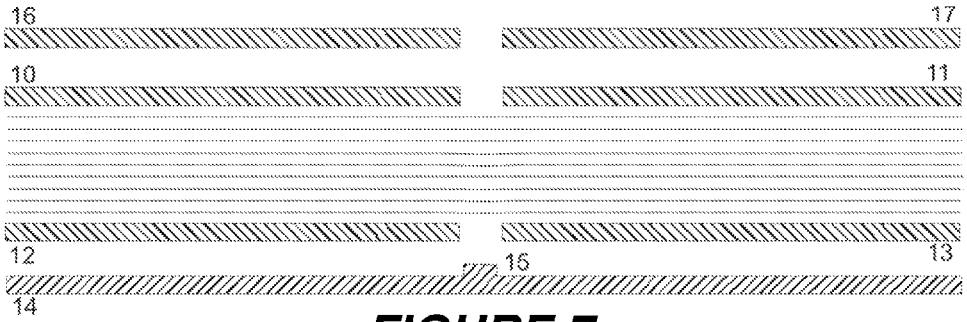
FIG. 7 adds two acceleration half-plates (16) and (17) which are needed to further accelerate the ions. By correct choice of the acceleration voltage at these half-plates, the distance to the puller half-plates, and the slit width, the disturbances of the dipolar field can be further reduced. It is essential that the dipolar field starting the acceleration of the ions is as homogeneous as possible.

FIGS. 5 to 7 now depict how these distortions of the acceleration field near the slits can be suppressed by correction electrode(s) outside the storage cell. The correction electrodes may be simple plates (FIG. 5) connected to a DC correction voltage of about +1000 volts, or plates with lengthy protrusions (FIG. 6), the latter reducing the correction voltage required to about +700 volts. As shown in FIG. 7, additional acceleration plates (16) and (17) with adjusted distance and adjusted acceleration voltage in front of puller plates (10) and (11) also can correct the dipole field near the slits. Usually still more acceleration plates are needed to accelerate the ions sufficiently. In commercial orthogonal time-of-flight mass spectrometers equipped with Mamyrin reflectors (as shown in FIG. 1), the ions are usually accelerated to a kinetic energy in the range of 5 to 20 kilovolts.

The operation procedure starts by applying the RF voltage to generate the storage field in form of a linear cell. At both ends, the storage cell can be closed by apertured electrodes (not shown). This storage cell is permanently filled with a collision gas at a pressure of about 0.01 to 0.1 Pascal. Ions of low kinetic energy are brought axially into the storage cell by the usual procedure for linear RF quadrupole systems. The ions are damped within a few milliseconds by collisions with the gas molecules, thereby gathering at the axis of the device. When the ions are sufficiently damped, they are ready to be pushed out into the flight tube of the mass spectrometer. The pushing process starts by switching off the RF voltage. This may be most readily done in an instant in the RF cycle when the potential is zero. However, for ion optical purposes, the RF voltage should be switched off at a point in time at which the ions' velocity due to micromotion is at its minimum. This is typically taken to be the phase in the RF cycle at which the instantaneous potential is at its maximum. In practice the optimum phase at which the RF is shut off may be determined experimentally.

If the acceleration field is now switched on without any delay, pushing the ions with their thermal movements into the flight tube of the time-of-flight mass spectrometer, the mass resolution is determined by the thermal energy of the ions transforming into a distribution of the arrival times at the detector. The mass resolution can, however, be improved by the well-known focusing method invented decades ago by W. C. Wiley and I. H. McLaren ("Time-of-Flight Mass Spectrometer with Improved Resolution", Rev. Scient. Instr. 26, 1150 (1955)). A delay time in the order of a microsecond is introduced between the removing time of the RF voltage and the applying time of the DC acceleration voltage. Within this delay time, the ion cloud expands by the instantaneous movement of the ions up to a diameter of about half a millimeter, the ions thereby assuming a correlation between their velocity in the pushing direction and their position in the cell. If now the DC acceleration voltage is switched on, the ions experience a focusing effect: ions moving against the pushing direction start from a higher electrical potential and catch up at some intermediate focus point within the flight tube with the ions having started from a lower potential. This intermediate focus point then has to be focused again by the reflector onto the detector.

There are many possible variations of the embodiment of the device described here. An example is presented in FIG. 9. Two different RF voltages with the same frequency are applied: a larger RF voltage (about +/−500 volts) between the puller half plates (top), and a smaller RF voltage (about +/−100 volts) with reversed phase between the pusher half plates (bottom). The resulting quadrupole field center is now positioned near to the slit in the pusher half plates. As a result, the ions gather in this position, and can be accelerated, in a given DC field between puller and pusher, to higher kinetic energies at the exit slit between the puller plates. Thus they enter the next acceleration field with higher kinetic energy, less sensitive to disturbances by small field inhomogeneities. A similar effect can be produced by slits of different widths between puller and pusher half plates.

Figure 9:
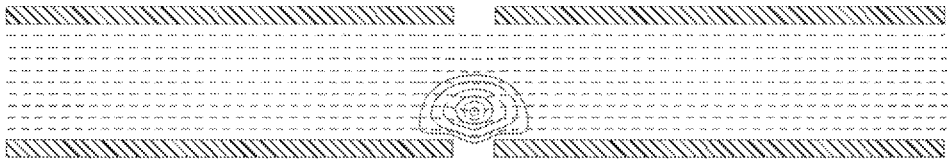
FIG. 9 presents an electrical field setting where the quadrupole field center is nearer to the slit in the pusher half plates (bottom). The RF voltage applied between the puller half plates (top) amounts to 500 volts, the RF voltage between the pusher half plates is 100 volts. In the DC field, the ions have a longer acceleration pathway to the puller plate and get more energy. They even may be started from a slightly bent DC field to spatially focus the ions into the puller slit. The bent DC field is generated by not fully correcting the DC field near the slit. Similar field shapes can be generated by asymmetric slit widths.

As shown in FIG. 9, the ions even can be focused onto the exit slit. If the small field distortions near the pusher slit are not completely compensated by the correction voltage, the curved equipotential surfaces focus the ions.

Figure 10:
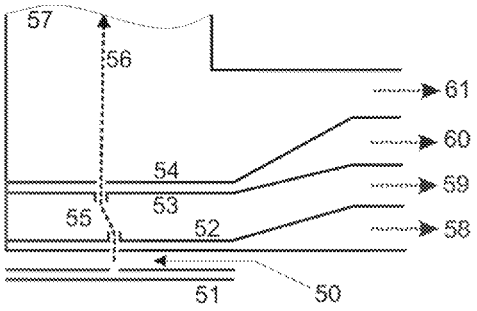
FIG. 10 schematically presents a pusher cell (50) according to principles of the invention, having correction plate (51) and acceleration diaphragms (52), (53), and (54). The acceleration diaphragms act as parts of a differential pumping system indicated by arrows (58) to (61). The differential pumping system keeps the pressure difference between $<10^{-6}$ Pascal in the flight tube (57), and about $10^{-1}$ Pascal in the pusher cell (50). Between acceleration diaphragms (52) and (53), the ion beam (56) is forced by deflection condensers to a chicane-like detour (55) to hinder the gas flowing unhindered through the slits in the diaphragms into the flight tube (57).

The ions leaving the storage cell by the DC voltage usually are accelerated to high kinetic energies of 5000 to 20000 electronvolts by a series of diaphragms with slits. FIG. 10 shows schematically such an arrangement with acceleration diaphragms (52), (53), and (54). These diaphragms can be designed as wall separators for vacuum chambers forming three or four differential pumping stages (58) to (61). Whereas the pressure within the storage cell (50) has to be maintained at about 0.1 Pascal, the pressure in the flight tube (57) should be lower than $10^{-6}$ Pascal. In a preferred embodiment, the ions are not just linearly accelerated, instead, there is a chicane-like detour (55) built in, the ions guided by deflection condensers (not shown in detail). This detour (55) hinders the gas molecules to directly fly through all slits of the stack of accelerator diaphragms into the flight tube.

Figure 8:
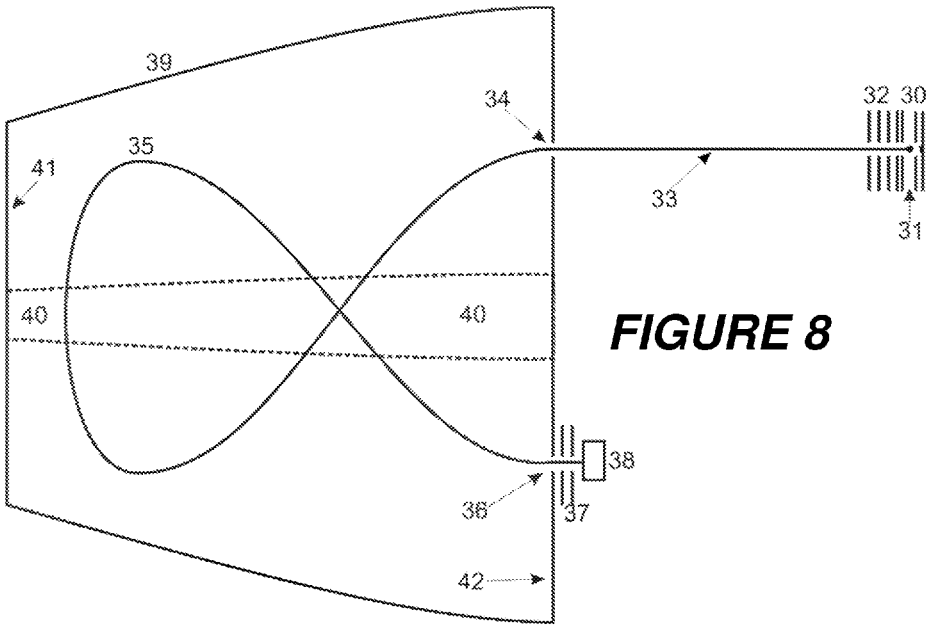
FIG. 8 shows schematically a pusher design (30) according to principles of the invention having acceleration plates (32), accelerating the ion cloud (31) towards the entrance slit (34) of a Cassini reflector with outer electrode (39) and two inner electrodes (40). The ion beam (35) is precisely focused onto the exit slit (36), then accelerated by electrodes (37) to high energy and measured by the ion detector (38). The Cassini reflector is closed at the rear and the front end by plates (41) and (42) which carry a fine electrode structure, generating the full Cassini field inside (see patent application DE 10 2013 011 462, C. Köster; as yet unpublished). The Cassini reflector can advantageously be operated with ions of low kinetic energy in the order of 300 Volts only, resulting in long flight times and high resolution.

A special embodiment of a time-of-flight mass spectrometer comprising a device according to principles of the invention is presented in FIG. 8, schematically showing an embodiment of the inventive pusher design (30) with acceleration plates (32), accelerating the ion cloud (31) towards the entrance slit (34) of a Cassini reflector. The Cassini reflector has an outer electrode (39) and two inner electrodes (40). The Cassini reflector can advantageously be operated with ions of low kinetic energy in the order of 300 Volts only, resulting in long flight times and high resolution. The ion beam (35) is precisely focused inside the Cassini reflector onto the exit slit (36). The ions are then accelerated by electrodes (37) to high energy and measured by the ion detector (38). The Cassini reflector is closed at the rear and the front end by plates (41) and (42) which carry a fine electrode structure, generating the full Cassini field inside (see patent application DE 10 2013 011 462, C. Köster)

The invention thus provides a pusher cell to pulse ions into the flight tube of a time-of-flight mass spectrometer, the pusher cell comprising a pusher plate and a puller plate, both plates being slotted by slits into electrically insulated half plates, an RF voltage generator, the voltage of which being applicable between the pusher half plates and, with reversed phase, between the puller half plates, the RF voltage generating a quadrupolar storage volume for ions between the slits of the plates, and a DC voltage generator, the voltage of which being applicable between pusher plate and puller plate, the DC voltage generating an accelerating field to push the ions into the flight tube.

The pusher cell may additionally comprise field correction electrodes outside the space between puller and pusher plate, and may additionally comprise a stack of acceleration diaphragms. The acceleration diaphragms may act as part of a differential pumping system, and the stack of acceleration diaphragms may comprise a chicane-like detour for the ions.

In a different embodiment of the pusher cell, the voltage generator can deliver two RF voltages of equal frequency but different amplitude, one RF voltage applied between the puller half plates, and the other RF voltage applied with reversed phase between the pusher half plates.

In a further embodiment, the pusher cell may serve in intermediate time periods as an ion guide to guide incoming ions through its RF quadrupole field to a device downstream of its exit. This downstream device may be, for instance, a second mass analyzer, like a single or triple quadrupole mass analyzer, a Paul or a Penning trap.

The invention furthermore presents a method to pulse ions into the flight tube of a time-of-flight mass spectrometer, comprising the steps (a) providing a pusher cell with a pusher plate and a puller plate, both plates being slotted by slits into electrically insulated half plates, (b) providing an RF voltage applied to the pusher half plates and, with reversed phase, to the puller half plates, the RF voltage generating a quadrupolar storage volume between the slits of the plates, (c) providing a collision gas in the storage volume, (d) filling the storage volume with ions, (e) waiting to damp the ions into a thread-like cloud, (f) removing the RF voltage, (g) inserting a delay period essentially without any field, and (h) applying a DC voltage between pusher plate and puller plate, thereby generating an accelerating field which accelerates the ions in the direction of the flight tube.

In another embodiment of the method, two RF voltages of the same frequency but different amplitudes may be applied, one RF voltage between the puller half plates, and the other RF voltage between the pusher half plates.

In further embodiments, the pusher cell may be used without collision gas. In such an embodiment, the inventive method comprises the steps of (a) providing a pusher cell with a pusher plate and a puller plate, both plates being slotted by slits into electrically insulated half plates, (b) providing an RF voltage applied to the pusher half plates and, with reversed phase, to the puller half plates, the RF voltage generating a quadrupolar storage volume between the slits of the plates, (c) allowing ions to propagate into the storage volume, (d) removing the RF voltage, (e) optionally inserting a delay period essentially without any field, and (f) applying a DC voltage between pusher plate and puller plate, thereby generating an accelerating field which accelerates the ions in the direction of the flight tube.

In yet another embodiment, the pusher cell may be used to hybridize the associated TOF analyzer with downstream devices and analyzers. Such downstream devices may be any known device including, for example, a quadrupole, Paul trap, or Penning trap. In such an embodiment, the pusher cell acts as an RF ion guide to guide ions from upstream devices to the hybridized downstream devices as long as the RF is applied. However, when the RF is removed and a DC voltage is applied, the ions are accelerated in the direction of the flight tube. In such an embodiment, the inventive method comprises the steps of (a) providing a pusher cell with a pusher plate and a puller plate, both plates being slotted by slits into electrically insulated half plates, (b) providing an RF voltage applied to the pusher half plates and, with reversed phase, to the puller half plates, the RF voltage generating a quadrupolar storage volume between the slits of the plates, (c) allowing a first group of ions to propagate from an upstream device, into an entrance end of the pusher cell, through the storage volume, and into a device at the exit end of the pusher cell, (d) allowing a second group of ions to propagate into the storage volume, (e) removing the RF voltage, (f) optionally inserting a delay period essentially without any field, and (g) applying a DC voltage between pusher plate and puller plate, thereby generating an accelerating field which accelerates the ions in the direction of the flight tube.

Those skilled in the art can easily work out further interesting applications on the basis of the devices and methods according to the invention for the ejection of ions into the flight tube of a mass spectrometer. These applications shall also be covered by this patent protection application for the part which is subject to this invention.

The invention claimed is:

1. A pusher cell to pulse ions into the flight tube of a time-of-flight mass spectrometer, comprising:

a pusher plate and a puller plate, both plates being slotted by slits into electrically insulated half plates;

an RF voltage generator, the voltage of which being applicable between the pusher half plates and, with reversed phase, between the puller half plates, the RF voltage generator being configured to generate a quadrupolar storage volume for ions between the slits of the plates;

a DC voltage generator, the voltage of which being applicable between pusher plate and puller plate, the DC voltage generator being configured to generate an accelerating field that accelerates the ions through the slit in the puller plate in a non-mass discriminating manner; and at least one correction electrode located outside the space between the pusher and puller plates to which a correction voltage is applied in order to correct for distortions of the accelerating field near an adjacent one of the slits, the correction electrode comprising a lengthy protrusion running along the slit in the pusher plate.

2. The pusher cell according to claim 1, additionally comprising a stack of acceleration diaphragms.

3. The pusher cell according to claim 2, wherein the acceleration diaphragms have slits through which the ions pass when being accelerated out of the quadrupolar storage volume.

4. The pusher cell according to claim 3, wherein the slits in the acceleration diaphragms are arranged to provide for a curved flight path for the ions that prevents gas from flowing unhindered through the slits into the flight tube.

5. The pusher cell according to claim 1, wherein the voltage generator can deliver two RF voltages of equal frequency but different amplitude, one RF voltage applicable between the puller half plates, and the other RF voltage applicable between the pusher half plates.

6. The pusher cell according to claim 1, further comprising an upstream device delivering ions and a downstream device receiving the ions, both the upstream and downstream devices being located at an entrance and an exit of the pusher cell, respectively, wherein the pusher cell serves as an ion guide to guide the ions incoming from the upstream device through its RF quadrupole field to the downstream device during periods in which no accelerating field is applied between the pusher and puller plates.

7. The pusher cell according to claim 6, wherein the downstream device is a mass analyzer.

8. A method to pulse ions into the flight tube of a time-of-flight mass spectrometer, comprising the steps of:

providing a pusher cell with a pusher plate and a puller plate, both plates being slotted by slits into electrically insulated half plates;

providing an RF voltage applied to the pusher half plates and, with reversed phase, to the puller half plates, the RF voltage generating a quadrupolar storage volume between the slits of the plates;

providing a collision gas in the storage volume;

filling the storage volume with ions;

waiting to damp the ions into an elongate cloud;

removing the RF voltage;

inserting a delay period without any field; and applying a DC voltage between pusher plate and puller plate, thereby generating an accelerating field which accelerates the ions through the slit in the puller plate in the direction of the flight tube in a non-mass discriminating manner, wherein a correction voltage is applied to at least one correction electrode located outside the space between the pusher and puller plates in order to correct for distortions of the accelerating field near an adjacent one of the slits, the correction electrode comprising a lengthy protrusion running along the slit in the pusher plate.

9. The method of claim 8, wherein the correction voltage applied to the at least one electrode outside the storage volume is a DC voltage.

10. The method of claim 8, wherein two RF voltages of the same frequency but different amplitudes are applied, one RF voltage between the puller half plates, and the other RF voltage between the pusher half plates.

11. The method of claim 9, wherein the correction voltage is applied such that the distortion of the accelerating field around the slit in the pusher plate is not corrected completely in order to focus the ions spatially into the slit in the puller plate.

12. A method to pulse ions into the flight tube of a time-of-flight mass spectrometer, comprising the steps of:

providing a pusher cell with a pusher plate and a puller plate, both plates being slotted by slits into electrically insulated half plates;

providing an RF voltage applied to the pusher half plates and, with reversed phase, to the puller half plates, the RF voltage generating a quadrupolar storage volume between the slits of the plates a center of which is located nearer to the slit in the pusher plate than to that in the puller plate;

filling the storage volume with ions;

removing the RF voltage; and applying a DC voltage between pusher plate and puller plate, thereby generating an accelerating field which accelerates the ions through the slit in the puller plate in the direction of the flight tube in a non-mass discriminating manner.

13. A method of hybridizing a time-of-flight analyzer to other ion optic devices, comprising the steps of:

providing a pusher cell with a pusher plate and a puller plate, both plates being slotted by slits into electrically insulated half plates;

providing an RF voltage applied to the pusher half plates and, with reversed phase, to the puller half plates, the RF voltage generating a quadrupolar storage volume between the slits of the plates;

allowing a first group of ions to propagate from an upstream device, into an entrance end of the pusher cell, through the storage volume, and into a device at the exit end of the pusher cell;

allowing a second group of ions to propagate into the storage volume, removing the RF voltage; and applying a DC voltage between pusher plate and puller plate, thereby generating an accelerating field which accelerates the ions through the slit in the puller plate in the direction of the flight tube in a non-mass discriminating manner, wherein a correction voltage is applied to at least one correction electrode located outside the space between the pusher and puller plates in order to correct for distortions of the accelerating field near an adjacent one of the slits, the correction electrode comprising a lengthy protrusion running along the slit in the pusher plate.

14. The method of claim 13, further comprising inserting a delay period without any field between the method steps of removing the RF voltage and applying the DC voltage.

15. The pusher cell of claim 1, wherein the correction voltage is a DC voltage.

16. The pusher cell of claim 1, wherein the half plates of the pusher plate and puller plate are supplied cross-wise with the two phases of an RF voltage to generate the quadrupolar storage volume between the slits of the plates.

17. The pusher cell of claim 1, wherein the flight tube comprises a Cassini reflector.

18. The method of claim 8, further comprising applying an acceleration voltage to acceleration half plates located outside the space between the pusher and puller plates adjacent to the puller plate.

19. The method of claim 12, wherein the displacement of the center of the quadrupolar storage volume is brought about by one of (i) applying an RF voltage to the puller half plates different to that applied to the pusher half plates and (ii) providing for different slit widths in the pusher and puller plates.

* * * * *